US011126137B2

(12) United States Patent
Kawashima

(10) Patent No.: US 11,126,137 B2
(45) Date of Patent: Sep. 21, 2021

(54) IMAGE FORMING APPARATUS

(71) Applicant: CANON KABUSHIKI KAISHA, Tokyo (JP)

(72) Inventor: Tomomichi Kawashima, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/018,028

(22) Filed: Sep. 11, 2020

(65) Prior Publication Data

US 2021/0080897 A1 Mar. 18, 2021

(30) Foreign Application Priority Data

Sep. 17, 2019 (JP) ..... JP2019-168727

(51) Int. Cl.
*G03G 15/04* (2006.01)
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1647; G03G 21/1676; G03G 21/1842; G03G 21/1864; G03G 2221/1684; G03G 2221/1869
USPC ..... 399/107, 110, 111, 119, 120
See application file for complete search history.

(56) References Cited

U.S. PATENT DOCUMENTS

| | | | | |
|---|---|---|---|---|
| 7,720,396 | B2 * | 5/2010 | Sato | G03G 21/1676 399/13 |
| 7,991,303 | B2 * | 8/2011 | Hattori | G03G 21/1864 399/9 |
| 8,837,982 | B2 * | 9/2014 | Matsuda | G03G 21/1647 399/111 |
| 9,020,392 | B2 * | 4/2015 | Hashimoto | G03G 15/0194 399/110 |
| 9,134,693 | B2 | 9/2015 | Kawamura et al. | |
| 2014/0169833 | A1 | 6/2014 | Kawamura et al. | |

FOREIGN PATENT DOCUMENTS

| | | |
|---|---|---|
| JP | 2014-134780 A | 7/2014 |
| JP | 2017-167523 A | 9/2017 |

* cited by examiner

*Primary Examiner* — Hoan H Tran
(74) *Attorney, Agent, or Firm* — Venable LLP

(57) ABSTRACT

An image forming apparatus includes a casing, a first photosensitive drum, a second photosensitive drum, a first developing unit, a second developing unit, a first pressing mechanism configured to press the first developing unit, and a second pressing mechanism configured to press the second developing unit. In addition, the image forming apparatus includes a first stay to which the first pressing mechanism is attached, and which is supported by the casing, and a second stay to which the second pressing mechanism is attached, and which is supported by the casing.

13 Claims, 10 Drawing Sheets

IMAGE FORMING APPARATUS

BACKGROUND OF THE INVENTION

Field of the Invention

The present invention relates to an image forming apparatus which forms an image on a sheet.

Description of the Related Art

Hitherto, an image forming apparatus of an electrophotographic system with an inline configuration, which includes a plurality of photosensitive drums, a plurality of developing rollers which come into contact with these photosensitive drums and develop toner images on surfaces of the photosensitive drums, and a transfer belt which comes into contact with the plurality of photosensitive drums are known. In the image forming apparatus described above, in a case where the photosensitive drum and the developing roller are in contact with each other for an extended period of time, a replacement timing of a component may be brought forward because of scratched surface layers or a deformation of the developing roller caused by friction between each other, and a deterioration of an image quality or unnecessary waste of a toner may accrue from soiling of the transfer belt.

Therefore, for example, as disclosed in Japanese Patent Laid-Open Nos. 2014-134780 and 2017-167523, the image forming apparatus in which the developing roller is configured to come into contact with and to be separated from the surface of the photosensitive drum so as to bring the developing roller into contact with the photosensitive drum only during a period to develop the toner image on the photosensitive drum has been devised.

In the image forming apparatus in which the plurality of developing rollers come into contact with and are separated from each of the photosensitive drums as described above, if vibration generated at contact and separation of another developing rollers with and from photosensitive drums is transmitted to the developing roller and the photosensitive drum between which development of the toner image is proceeding, a patchy pattern in light and shade may appear in the toner image. In such a case, the image quality formed on a sheet may be deteriorated.

SUMMARY OF THE INVENTION

According to one aspect of the present invention, an image forming apparatus includes a casing, a first photosensitive drum on which an electrostatic latent image is formed, a second photosensitive drum disposed next to the first photosensitive drum, and on which an electrostatic latent image is formed, a first developing unit comprising a first developing member configured to develop the electrostatic latent image formed on the first photosensitive drum by supplying the toner to the first photosensitive drum, the first developing unit being configured to be movable between a first position where the first developing member comes into contact with the first photosensitive drum and a second position where the first developing member is separated from the first photosensitive drum, a second developing unit comprising a second developing member configured to develop the electrostatic latent image formed on the second photosensitive drum by supplying the toner to the second photosensitive drum, the second developing unit being configured to be movable between a third position where the second developing member comes into contact with the second photosensitive drum and a fourth position where the second developing member is separated from the second photosensitive drum, a first pressing mechanism configured to press the first developing unit from the second position to the first position, a second pressing mechanism configured to press the second developing unit from the fourth position to the third position, a first stay to which the first pressing mechanism is attached, and which is supported by the casing, and a second stay to which the second pressing mechanism is attached, and which is supported by the casing.

Further features of the present invention will become apparent from the following description of exemplary embodiments with reference to the attached drawings.

DESCRIPTION OF THE EMBODIMENTS

Hereinafter, an image forming apparatus according to this embodiment will be described with reference to attached drawings. To be noted, although the image forming apparatus includes such as a printer, a copying machine, a facsimile machine, and a composite machine, a tandem type full color laser beam printer will be described as an example in this embodiment.

Further, in a following description, a sheet includes, other than a standard paper, a special sheet such as a coated paper, a recording material of a special shape such as an envelope and an index sheet, a plastic film for an overhead projector, a cloth, and the like. In addition, a document is included in a concept of the sheet, and may be a blank sheet of paper, or with single-sided or double-sided image formation. Further, hereinafter, a direction perpendicularly intersecting with a horizontal and a vertical direction (gravity direction) in FIG.

Figure 1:
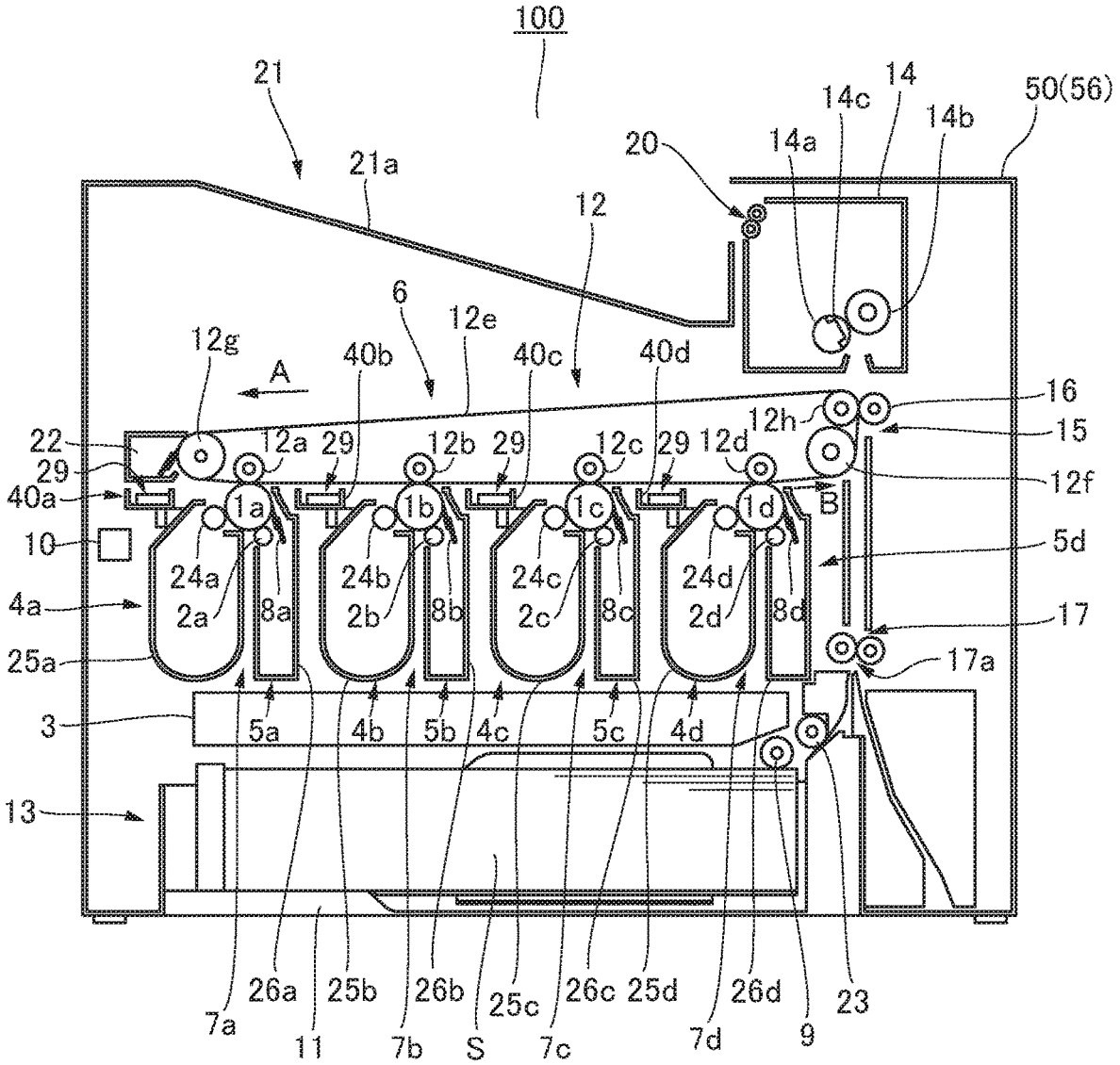
FIG. 1 is a schematic cross-sectional view of a printer according to this embodiment.

1 is referred to as a width direction, one side of the width direction, which is a front side in FIG. 1, is referred to as a front direction, and an opposite side of the front direction is referred to as a back direction.

General Configuration

FIG. 1 is a schematic cross-sectional view of a printer 100 when viewed from the front direction. As shown in FIG. 1, the printer 100 forms an image by an electrophotographic recording system, and includes a printer body 50, and a sheet feeding unit 13, which feeds the sheet. Further, the printer 100 includes an image forming unit 6, which forms the image on the sheet, and a fixing unit 14, which fixes a toner image on the sheet.

The printer body 50 supports each part of the printer 100, and protects each part by covering these parts. A sheet discharge tray 21 is disposed in an upper part of the printer body 50, and stacks the sheet S discharged from the printer 100.

The sheet feeding unit 13 includes a feed cassette 11, a feed roller 9 which conveys the sheet from the feed cassette 11, a separation roller 23, and a registration roller pair 17. Since the feed cassette 11 is able to stack and store the sheet S and is freely detachable from the printer body 50, a worker sets the sheet inside the feed cassette 11 in a state where the feed cassette 11 is detached, and supplies the sheet by attaching the feed cassette 11 to the printer body 50.

The feed roller 9 comes into contact with an uppermost surface of the sheet S stored in the feed cassette 11, and rotates to feed the sheet. The separation roller 23 is disposed downstream of the feed roller 9, and conveys the sheet while separating plurally overlapping sheets into one by one. The registration roller pair 17 abuts a leading edge of the sheet S provided with a conveyance load by the separation roller 23 on a nip portion 17*a* of the registration roller pair 17, which is stopping, so that the sheet S is aligned and a skew of the sheet S is corrected.

The image forming unit 6 includes a process cartridge 7*a*, serving as a first process cartridge, and a process cartridge 7*b*, serving as a second process cartridge, a process cartridge 7*c*, and a process cartridge 7*d*, for yellow, magenta, cyan, and black. Further, the image forming unit 6 includes an exposing unit 3, an intermediate transfer unit 12, and a plurality of pressing mechanisms 29, which are provided corresponding to each of the process cartridges.

Each of the process cartridges 7*a*, 7*b*, 7*c*, and 7*d* described above stores a toner in a sequence of yellow, magenta, cyan, and black, and is disposed along the intermediate transfer unit 12 in a left to right direction in FIG. 1. The process cartridges 7*a* to 7*d* respectively include a photosensitive drum 1*a*, serving as a first photosensitive drum of an image bearing member, and a photosensitive drum 1*b*, serving as second photosensitive drum which is disposed next to the first photosensitive drum, a photosensitive drum 1*c*, and a photosensitive drum 1*d*. Further, these process cartridges 7*a* to 7*d* respectively include charge rollers 2*a*, 2*b*, 2*c*, and 2*d*, and cleaning blades 8*a*, 8*b*, 8*c*, and 8*d*, both of which correspond to each of the photosensitive drums 1*a* to 1*d*. Further, these process cartridges 7*a* to 7*d* respectively include a developing roller 24*a*, serving as a first developing member, and a developing roller 24*b*, serving as second developing member, a developing roller 24*c*, and a developing roller 24*d*, which correspond to each of the photosensitive drums 1*a* to 1*d*. Since the process cartridges 7*a* to 7*d* are basically similar except for differences in colors of toners stored therein, the process cartridge 7*a* of yellow will be described below, and descriptions of other process cartridges are omitted herein. It is noted that any one of the photosensitive drums 1*a* to 1*d* can serves the first photosensitive drum or the second photosensitive drum.

In the process cartridge 7*a*, the charge roller 2*a*, the developing roller 24*a*, and the cleaning blade 8*a*, which cleans a surface of the photosensitive drum 1*a*, are disposed around the photosensitive drum 1*a* in a sequence along a clockwise direction, which is a rotation direction of the photosensitive drum 1*a*, shown in FIG. 1. The photosensitive drum 1*a* is formed by coating an organic photoconductive layer (OPC) on an outer peripheral surface of an aluminum cylinder, and both ends of the photosensitive drum 1*a* are supported in a feely rotatable manner by bearings and the like. The photosensitive drum 1*a* is rotatably driven by a driving force transmitted to one of the ends thereof from a driving unit, not shown.

The charge roller 2*a* is an electric conductive roller which comes into contact with the surface of the photosensitive drum 1*a*, and, while an electrifying voltage being applied by a power source, not shown, charges the surface of the photosensitive drum 1*a* at a uniform electric potential. A laser beam is irradiated on this uniformly charged surface of the photosensitive drum 1*a* from the exposing unit 3 disposed below the photosensitive drum 1*a* based on a signal of an image data, and an electrostatic latent image is formed on the surface of the photosensitive drum 1*a*.

In a state where the developing roller 24*a* is in contact with the photosensitive drum 1*a*, while being rotatably driven by the driving force transmitted from the driving unit, not shown, and being applied with a developing bias, the developing roller 24*a* develops the electrostatic latent image by adhering the toner to the electrostatic latent image formed on the surface of the photosensitive drum 1*a*. To be noted, in this embodiment, the pressing mechanism 29 operates the developing roller 24*a* to come into contact with and to be separated from the photosensitive drum 1*a*. Detail of the pressing mechanism 29 will be described later.

The intermediate transfer unit 12 includes an endless cylindrical shaped intermediate transfer belt 12*e*, serving as an intermediate transfer material, a driving roller 12*f*, a driven roller 12*g*, primary transfer rollers 12*a*, 12*b*, 12*c*, and 12*d*, and a secondary transfer internal roller 12*h*. This intermediate transfer belt 12*e* is stretched by being wound around these rollers.

The driven roller 12*g* is urged by an urging member, not shown, in a direction from inside to outside the intermediate transfer belt 12*e* (arrow A direction in FIG. 1), and applies a tension to the intermediate transfer belt 12*e*. Each of the primary transfer rollers is disposed to face each of the photosensitive drums of yellow, magenta, cyan, and black described above across the intermediate transfer belt 12*e*, and forms a primary transfer portion with each of the photosensitive drums of each color.

As a transfer bias is applied to the primary transfer roller at the primary transfer portion, the toner image of each color formed on each of the photosensitive drums is superimposed in a sequence of yellow, magenta, cyan, and black on each other, and a full color toner image is primarily transferred to the intermediate transfer belt 12*e*. To be noted, in this embodiment, the intermediate transfer belt 12*e* is rotated in an arrow B direction in FIG. 1 at a predetermined speed by the driving roller 12*f* which is rotatably driven by a driving force transmitted from the driving unit, not shown. Further, the cleaning blade 8*a* comes into contact with the surface of the photosensitive drum 1*a*, and removes a residual toner remained on the surface of the photosensitive drum 1*a* after a primary transfer.

The secondary transfer internal roller 12*h* is disposed downstream of the primary transfer portion described above in a rotation direction of the intermediate transfer belt 12*e* (arrow B direction), and formed a secondary transfer portion 15 with a secondary transfer external roller 16 facing the secondary transfer internal roller 12*h* across the intermediate transfer belt 12*e*. As the transfer bias is applied to the secondary transfer external roller 16, the secondary transfer portion 15 secondarily transfers the full color toner image formed on the intermediate transfer belt 12*e* to the sheet. To be noted, after the toner image has been secondarily transferred to the sheet by the secondary transfer portion 15, a residual toner remained on the intermediate transfer belt 12*e* is removed by a belt cleaning unit 22.

The fixing unit 14 to fix an unfixed toner image, which has been transferred to the sheet, to the sheet is disposed downstream of the secondary transfer portion 15. The fixing unit 14 includes a fixing film 14*a*, a press roller 14*b*, a heating element 14*c*, and a sheet discharge roller pair 20. The fixing film 14*a* is an endless cylindrical shaped belt, and an outer peripheral surface of the fixing film 14*a* is disposed to be able to come into contact with a surface of the sheet on which the toner image has been formed.

The heating element 14*c* is disposed inside the fixing film 14*a*, and heats the fixing film 14*a* by coming into contact with the fixing film 14*a*. The press roller 14*b* is in pressure contact with the heating element 14*c* via the fixing film 14*a*, forms a heating nip with the fixing film 14*a* in between, and rotates the fixing film 14*a* by rotatably driven with the driving force transmitted from the driving unit, not shown. The secondary transfer portion 15 fusion bonds the toner and fixes the toner image to the sheet by heating the unfixed toner image under pressure at this heating nip.

The sheet discharge roller pair 20, which discharges the sheet fixed with the toner image by the fixing unit 14, and the sheet discharge tray 21 are disposed downstream of the fixing unit 14. The sheet discharge tray 21 has an inclined surface 21*a* in which a side of the sheet discharge roller pair 20 is lowered, and supports the sheet discharged by the sheet discharge roller pair 20. The inclined surface 21*a* stacks a discharged sheet in an inclined state, and suppresses extrusion of a preceding paper by a succeeding sheet.

Next, an image forming operation of the printer 100 which is configured as described above will be described. For example, when the image data is input to the exposing unit 3 from a personal computer or the like disposed outside, not shown, the laser beam corresponding to the image data is irradiated on each of the photosensitive drums 1*a* to 1*d* of the process cartridges 7*a* to 7*d*.

At this time, the surfaces of the photosensitive drums 1*a* to 1*d* have been uniformly charged in advance at a predetermined polarity and electric potential by the charge roller, and the electrostatic latent image is formed on the surfaces of the photosensitive drums by being irradiated with the laser beam from the exposing unit 3. The electrostatic latent image formed on the photosensitive drum 1*a* is developed by the developing roller 24*a*, and the toner image of yellow (Y) is formed on the photosensitive drum 1*a*.

Similarly, the laser beam is irradiated on each of the photosensitive drums 1*b*, 1*c*, and 1*d* of the process cartridges 7*b*, 7*c*, and 7*d* from the exposing unit 3, and the toner images of magenta (M), cyan (C), and black (K) are formed on each of the photosensitive drums. Each color of the toner images formed on each of the photosensitive drums is transferred to the intermediate transfer belt 12*e* at the primary transfer portion by the primary transfer rollers 12*a* to 12*d*, and conveyed to the secondary transfer portion 15 by the intermediate transfer belt 12*e* which is rotated by the driving roller 12*f*. To be noted, an image forming process of each color is performed in a timing so that the toner image is superimposed on the toner image which has been primarily transferred to an upstream side of the intermediate transfer belt 12*e*.

In parallel with this image forming process, the sheet S stacked and stored in the feed cassette 11 of the printer 100 is fed by the feed roller 9. Then, the sheet S fed by the feed roller 9 is separated into one by one by the separation roller 23, and, with the sheet skew being corrected by the registration roller pair 17, is conveyed to the secondary transfer portion 15 in a timing synchronizing with conveyance of the toner image primarily transferred to the intermediate transfer belt 12*e*.

The sheet S conveyed to the secondary transfer portion 15 is transferred with the full color toner image formed on the intermediate transfer belt 12*e*. The sheet S transferred with the toner image is provided with heat and pressure at the fixing unit 14, and the toner image is fixed. The sheet S passed through the fixing unit 14 is discharged to the sheet discharge tray 21 by the sheet discharge roller pair 20.

Configuration of Printer Body

Figure 2:
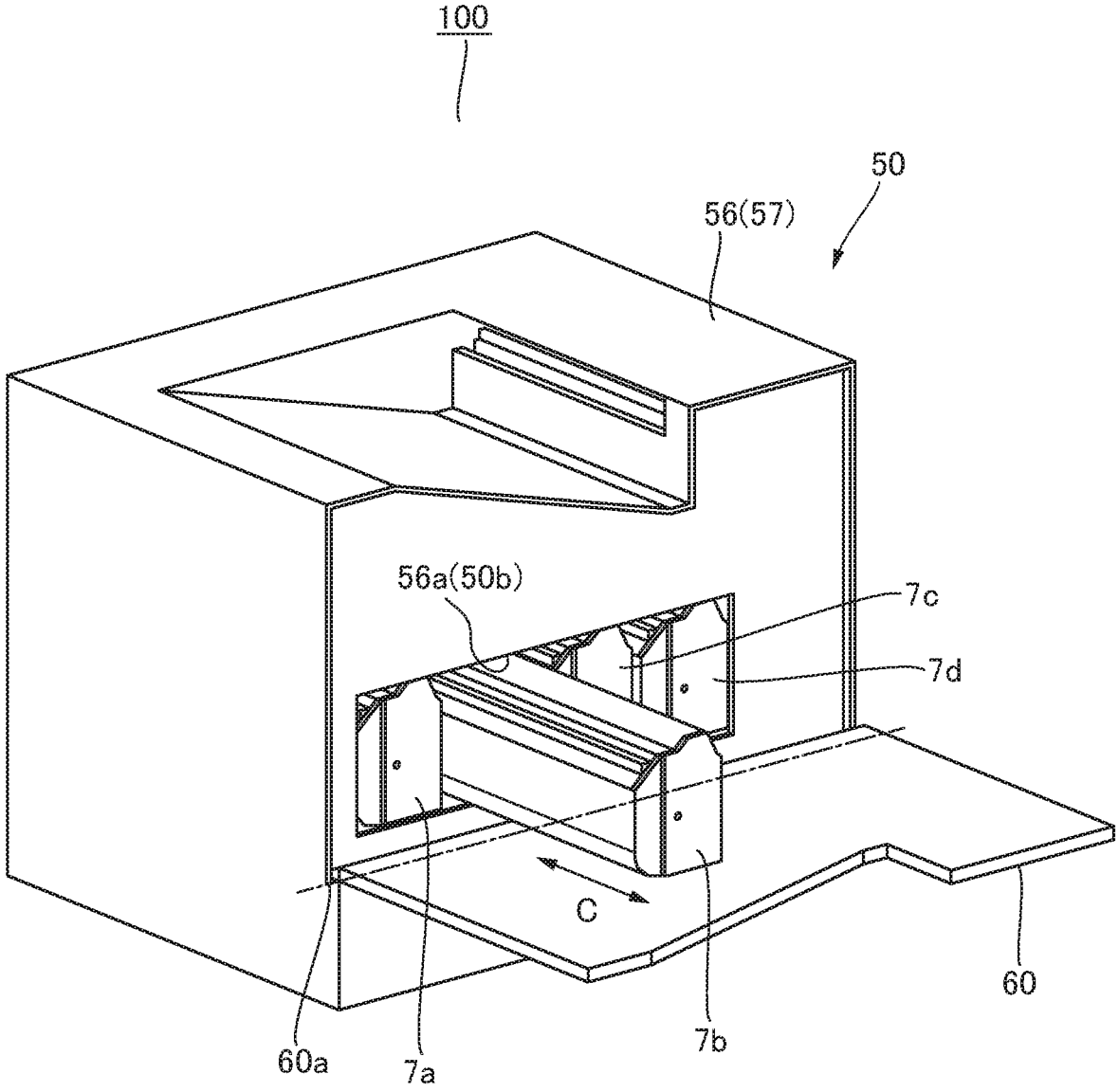
FIG. 2 is an overall perspective view showing the printer with a front door being opened.
Figure 3:
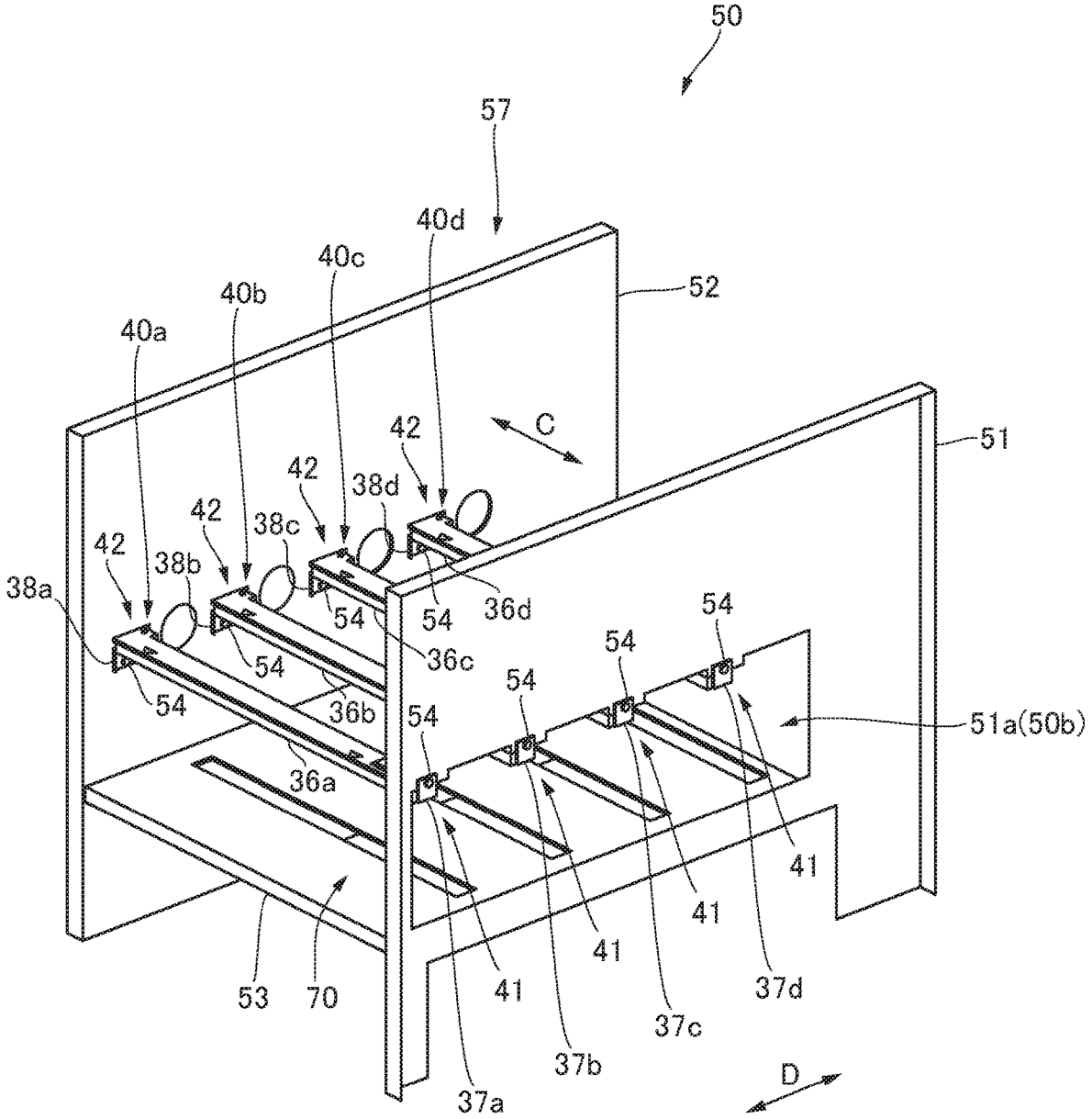
FIG. 3 is a perspective view showing a casing and stay units.

FIG. 2 is a perspective view showing the printer 100. FIG. 3 is a perspective view showing the printer body 50 with an exterior portion 56 being not shown. As shown in FIGS. 2 and 3, the printer body 50 includes a casing 57, a front door 60, serving as an openable door, a stay 36*a*, serving as a first stay to reinforce the casing 57, and a stay 36*b*, serving as a second stay, a stay 36*c*, and a stay 36*d*.

The casing 57 includes the exterior portion 56 described above, a front direction side plate 51, serving as a first side plate, which is disposed in the front direction inside the exterior portion 56, a back direction side plate 52, serving as a second side plate, which is disposed in the back direction inside the exterior portion 56, and a main stay 53. The exterior portion 56 is formed in a shape of box, and an opening portion is formed in the front direction to carry out maintenance of the printer 100.

The front and the back direction side plate 51 and 52 are provided along the vertical and horizontal direction in FIG. 1, and disposed to face each other with a predetermined space in an axial direction of the photosensitive drum 1*a* (width direction C). The front and the back direction side plate 51 and 52 are coupled to each other by the main stay 53, which is formed approximately parallel to the horizontal direction, and the stays 36*a* to 36*d* disposed above the main stay 53.

The main stay 53 determines relative positions of the front and the back direction side plate 51 and 52 in the width direction C so that a space between the front and the back direction side plate 51 and 52 becomes a predetermined space, and also determines relative rotational positions of the front and the back direction side plate 51 and 52 when viewed in the width direction C. Further, the main stay 53 includes a plurality of cartridge holder units 55 (refer to FIG. 5) which are provided corresponding to each of the process cartridges 7*a* to 7*d* and hold each of the process cartridges. The cartridge holder units 55 are extended in the width direction C, and support the process cartridges 7*a* to 7*d* movably in the width direction C. Further, a position of each of the process cartridges 7*a* to 7*d* in a direction D (horizontal direction in FIG. 1) is determined by these cartridge holder units 55. To be noted, this width direction C is hereinafter also referred to as an attachment/detachment (insertion/removal) direction of the process cartridges 7*a* to 7*d*.

The stays 36*a* to 36*d* are provided one by one corresponding to each of the process cartridges 7*a* to 7*d*, and disposed adjacent to corresponding process cartridges 7*a* to 7*d*. In more particular, the stays 36*a* to 36*d* are disposed above the corresponding process cartridges 7*a* to 7*d*, and attachable to and detachable from the casing 57. Further, each of the stays 36*a* to 36*d* is extended in the attachment/detachment direction C of the process cartridge, and disposed with a space between adjacent stays in the direction D, in which the photosensitive drums 1*a* to 1*d* are disposed parallel to each other, in FIG. 3. Detail of the stays 36*a* to 36*d* will be described later.

A storage space 70 which is capable to store the process cartridges 7*a* to 7*d* is formed between the main stay 53 and the stays 36*a* to 36*d*. In this storage space 70, an opening 50*b* which is opening in the front direction is formed by an opening portion 56*a* of the exterior portion 56 and an opening portion 51*a* formed in the front direction of the front direction side plate 51.

As shown in FIG. 2, the front door 60 is supported by the casing 57 in an openable and closable manner, between a closed position to cover the opening 50*b* of the storage space 70 and an opening position to expose the opening 50*b* outside, around a rotation center line 60*a* as a center. In this embodiment, in a state where the front door 60 is at the opening position, it is possible to access the process cartridges 7*a* to 7*d*, and the worker is able to carry out a work such as replacement of the process cartridge. To be noted, the front door 60 is not limited to be openable and closable in the vertical direction. It is acceptable that the front door 60 is openable and closable in the horizontal direction, and also acceptable that front door 60 is openable and closable by attaching to and detaching from the casing body.

Configuration of Process Cartridge

Figure 4:
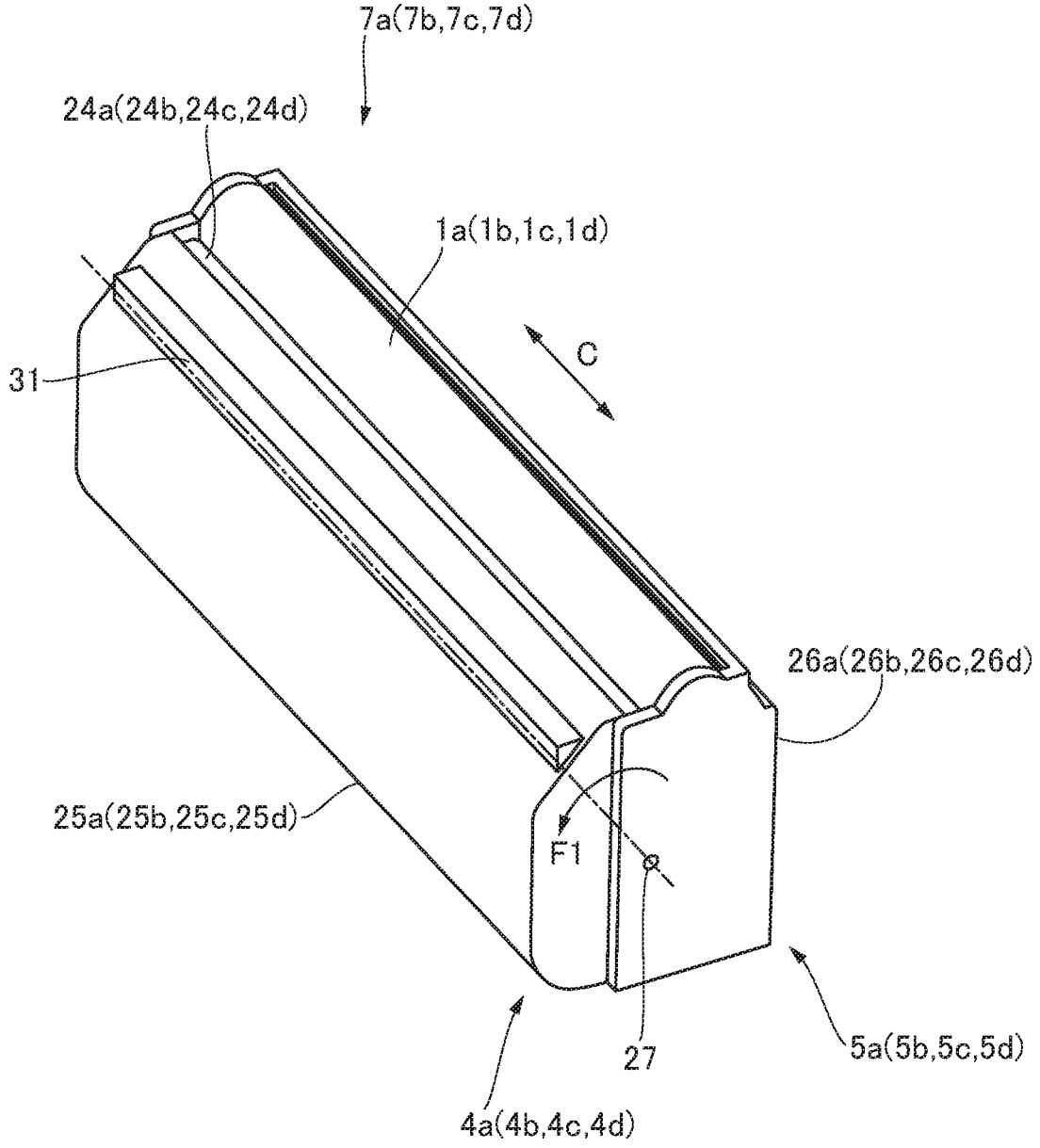
FIG. 4 is a perspective view showing an external appearance of a process cartridge.
Figure 5:
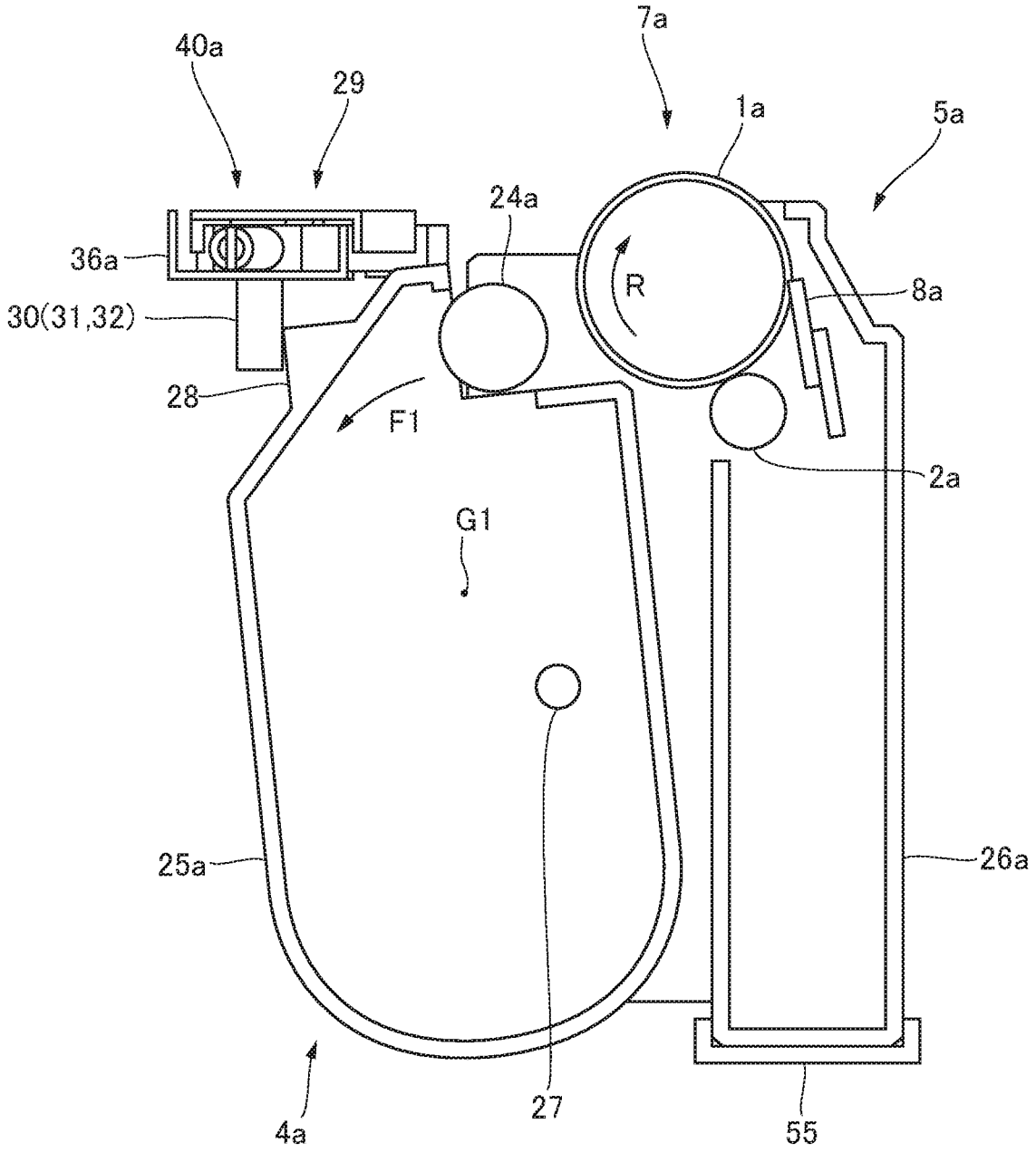
FIG. 5 is a cross-sectional view showing the process cartridge and the stay unit when viewed from a front side with a developing roller being at a separated position.
Figure 6:
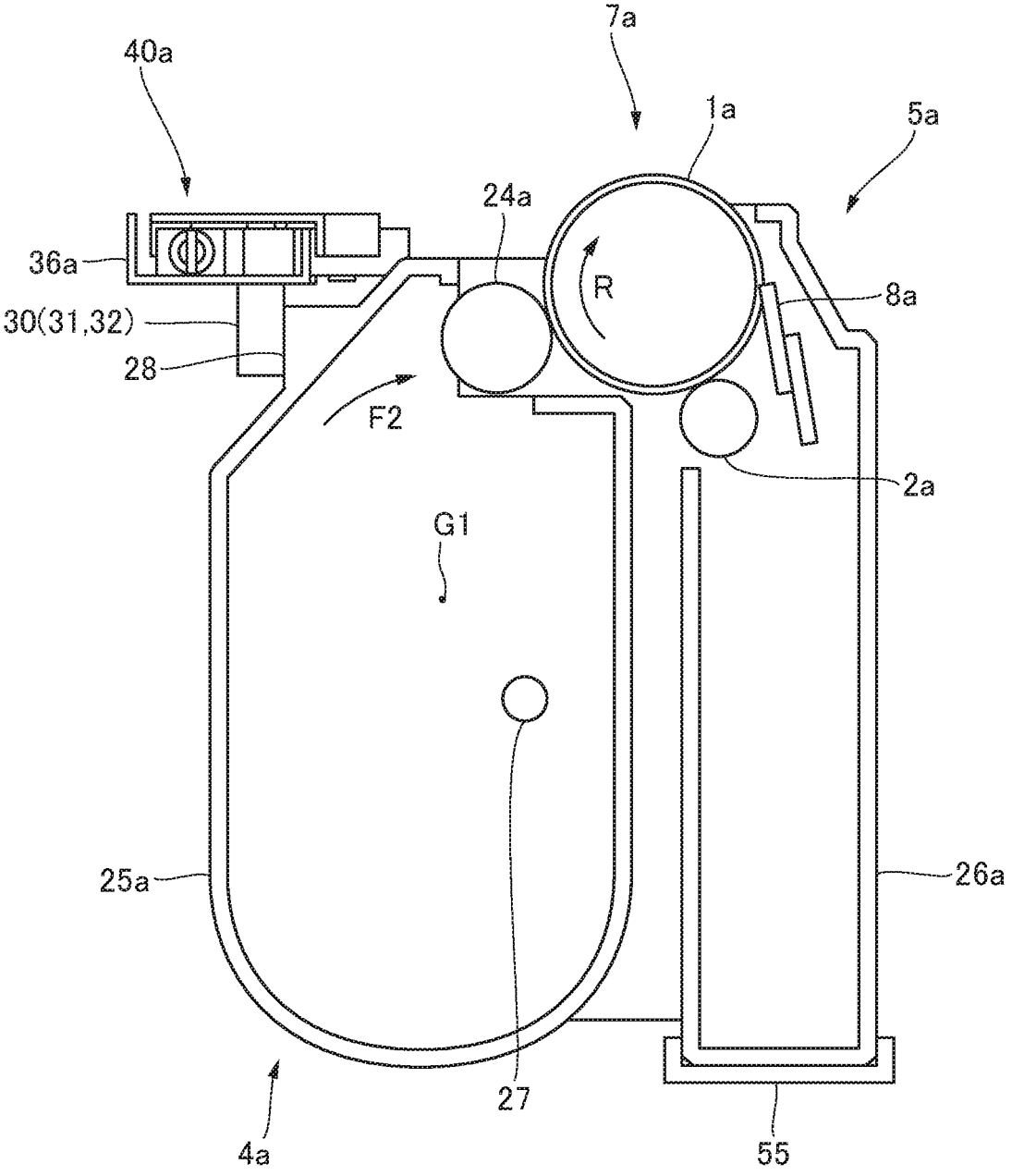
FIG. 6 is a cross-sectional view showing the process cartridge and the stay unit when viewed from the front side with the developing roller being at a contact position.

FIG. 4 is a perspective view showing an external view of the process cartridge 7*a*. FIGS. 5 and 6 are cross-sectional views of the process cartridge 7*a* and a stay unit 40*a*, described later, when viewed from the front. Hereinafter, a configuration of the process cartridge 7*a* of yellow will be described, and descriptions of the process cartridges of other colors will be omitted herein.

Each process cartridge is extended in the axial direction of the photosensitive drum 1*a* (width direction C), and includes a cleaning unit and a developing unit. In particular, the process cartridge 7*a* includes the cleaning unit 5*a* and the developing unit 4*a*, serving as a first developing unit, and the process cartridge 7*b* includes the cleaning unit 5*b* and the developing unit 4*b*, serving as a second developing unit. Further, the process cartridge 7*c* includes the cleaning unit 5*c* and the developing unit 4*c*, and the process cartridge 7*d* includes the cleaning unit 5*d* and the developing unit 4*d*.

Further, each of the process cartridges 7*a* to 7*d* is unitized so that it is possible to insert and remove each of the process cartridges into and from the storage space 70 independently from each other by moving the process cartridge in the width direction C with respect to the printer body 50. That is, each of the process cartridges 7*a* to 7*d* is configured to be detachably attached to the casing 57 through the opening 50*b*. For example, the cleaning unit 5*a* includes the photosensitive drum 1*a*, the charge roller 2*a*, the cleaning blade 8*a*, and a residual toner container 26*a* which stores the residual toner removed from the surface of the photosensitive drum 1*a* by the cleaning blade 8*a*. To be noted, it is acceptable if the process cartridge is unitized as a cartridge in which at least an image bearing member, such as the photosensitive drum, to form the electrostatic latent image and a developing means, such as the developing roller, to develop the electrostatic latent image on the image bearing member are integrally attachable to and detachable from the casing.

The photosensitive drum 1*a* and the charge roller 2*a* are rotatably supported by the residual toner container 26*a*. The residual toner container 26*a* is able to engage with the cartridge holder unit 55 described above, and a position of the process cartridge 7*a* with respect to the casing 57 in the direction D (horizontal direction in FIG. 1) is determined in a state where the residual toner container 26*a* and the cartridge holder unit 55 are engaged with each other.

For example, the developing unit 4*a* includes the developing roller 24*a* described above and a toner container 25*a*, serving as a developer container, to store each color of the toners so as to supply the toner to the surface of the photosensitive drum 1*a*. The toner container 25*a* rotatably supports the developing roller 24*a*, and, with respect to the residual toner container 26*a*, is supported in a manner capable to swing around a swing axis 27 as a center. Herewith, the developing unit 4*a* is capable to swing between a contact position, which is a first position, where the developing roller 24*a* comes into contact with the surface of the photosensitive drum 1*a*, and a separated position, which is a second position, where the developing roller 24*a* is separated from the surface of the photosensitive drum 1*a*. FIG. 5 shows a state where the developing unit 4*a* is at the separated position, and FIG. 6 shows a state where the developing unit 4*a* is at the contact position. To be noted, although detail descriptions are omitted herein, the process cartridges 7*b* to 7*d* are similarly configured. For example, the developing unit 4*b* is able to swing between a contact position, which is a third position, where the developing roller 24*b* comes into contact with the surface of the photosensitive drum 1*b*, and a separated position, which is a fourth position, where the developing roller 24*b* is separated from the surface of the photosensitive drum 1*b*.

Further, in a case where the developing unit 4*a* is at the separated position, it is acceptable to determine a pivot position of the toner container with respect to the residual toner container either by the residual toner container or by another member such as a pressing portion 30, described later. In addition, it is acceptable to support the developing unit and the photosensitive drum by another member which is provided independently from the cleaning unit, such as a cover member of the process cartridge.

In a state where the toner is filled up in the developing unit 4*a*, the swing axis 27 is disposed such that, while above the swing axis 27, a gravity center G1 of the developing unit 4*a* is downstream, in an arrow F1 direction, of a position where a turning force is not generated in the developing unit 4*a* by an own weight thereof and, while below the swing axis 27, the gravity center G1 is upstream, in the arrow F1 direction, of a position where the turning force is not generated in the developing unit 4*a* by the own weight thereof. Further, in a state where the toner is not filled in the developing unit 4*a*, the swing axis 27 is disposed such that, while above the swing axis 27, the gravity center G1 of the developing unit 4*a*, not shown, is downstream, in the arrow F1 direction, of a position where the turning force is not generated in the developing unit 4*a* by the own weight thereof and, while below the swing axis 27, the gravity center G1 is upstream, in the arrow F1 direction, of a position where the turning force is not generated in the developing unit 4*a* by the own weight thereof. In other words, in this embodiment, regardless of a quantity of the toner contained in the developing unit 4*a*, the gravity center G1 is always on a left side of the swing axis 27 (on a side of the stay unit) in the developing unit 4*a*. Herewith, a force to pivot the developing roller 24*a* in the arrow F1 direction in FIG. 5, that is a direction to separate the developing roller 24*a* from the photosensitive drum 1*a*, is generated by own weight thereof regardless of a quantity of the toner contained in the developing unit 4*a*. Further, it is not limited to this configuration in which the developing unit is pivoted in a direction so as to separate the developing roller 24*a* from the photosensitive drum 1*a* by the own weight thereof, and, for example, it is acceptable to include an urging member which urges the process cartridge in the direction to separate the developing roller from the photosensitive drum.

Detail of Stay and Pressing Mechanism

The image forming unit 6 includes a plurality of pressing mechanisms 29 which are provided corresponding to each of the process cartridges and the stays to bring and separate the developing rollers into contact with and from corresponding photosensitive drums. In this embodiment, a total of 4 pressing mechanisms, one for each of the process cartridges 7*a* to 7*d*, is provided. For example, the pressing mechanism 29, serving as a first pressing mechanism, is provided to the process cartridge 7*a*, and the pressing mechanism 29, serving as a second pressing mechanism, is provided to the process cartridge 7*b*. By this pressing mechanism 29 pressing on a pressed portion 28, the developing roller moves from a first position shown in FIG. 5 to a contact position shown in FIG. 6, and the developing roller and the photosensitive drum come into contact with each other so that it becomes possible to develop the electrostatic latent image. Each of the pressing mechanisms 29 and the stays are basically similar in a configuration and a shape except for a disposition thereof, the pressing mechanism 29 and the stay 36*a* of the process cartridge 7*a* will be described below, and descriptions of the pressing mechanisms and the stays of the process cartridges of other colors will be omitted herein.

Figure 7A:
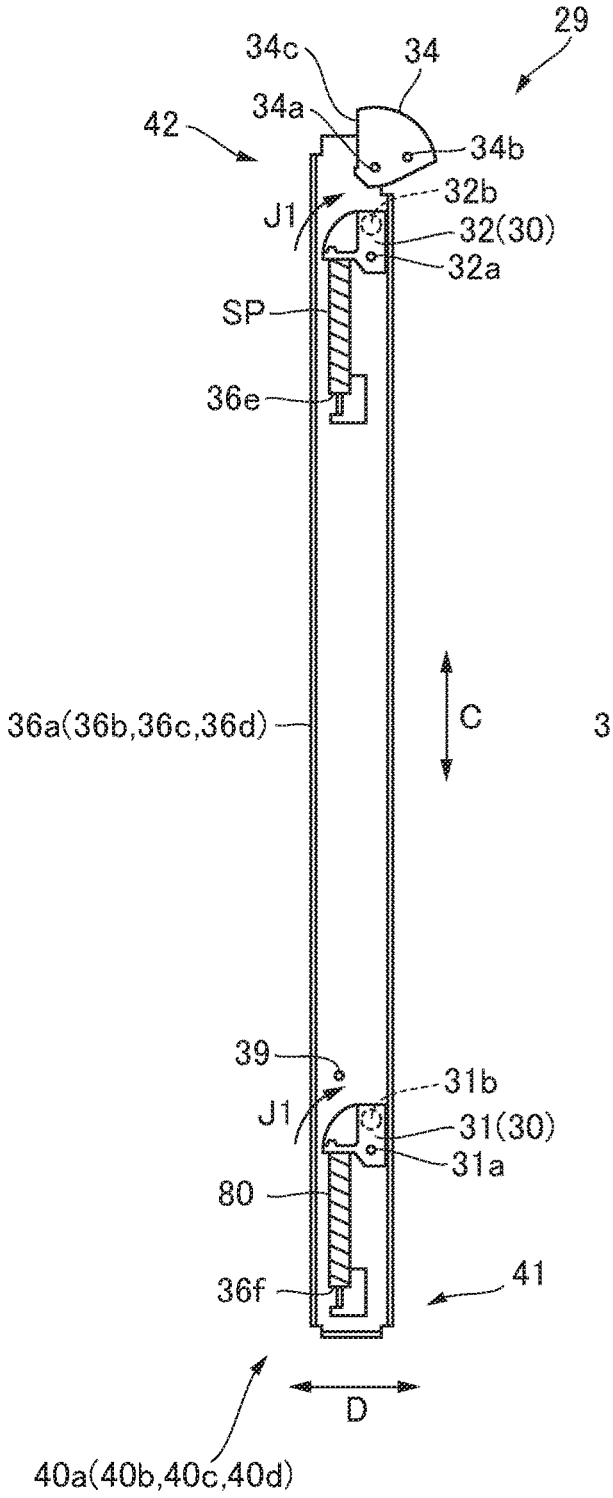
FIG. 7A is a front view showing the stay unit with a pressing mechanism being in a pressing state.
Figure 7B:
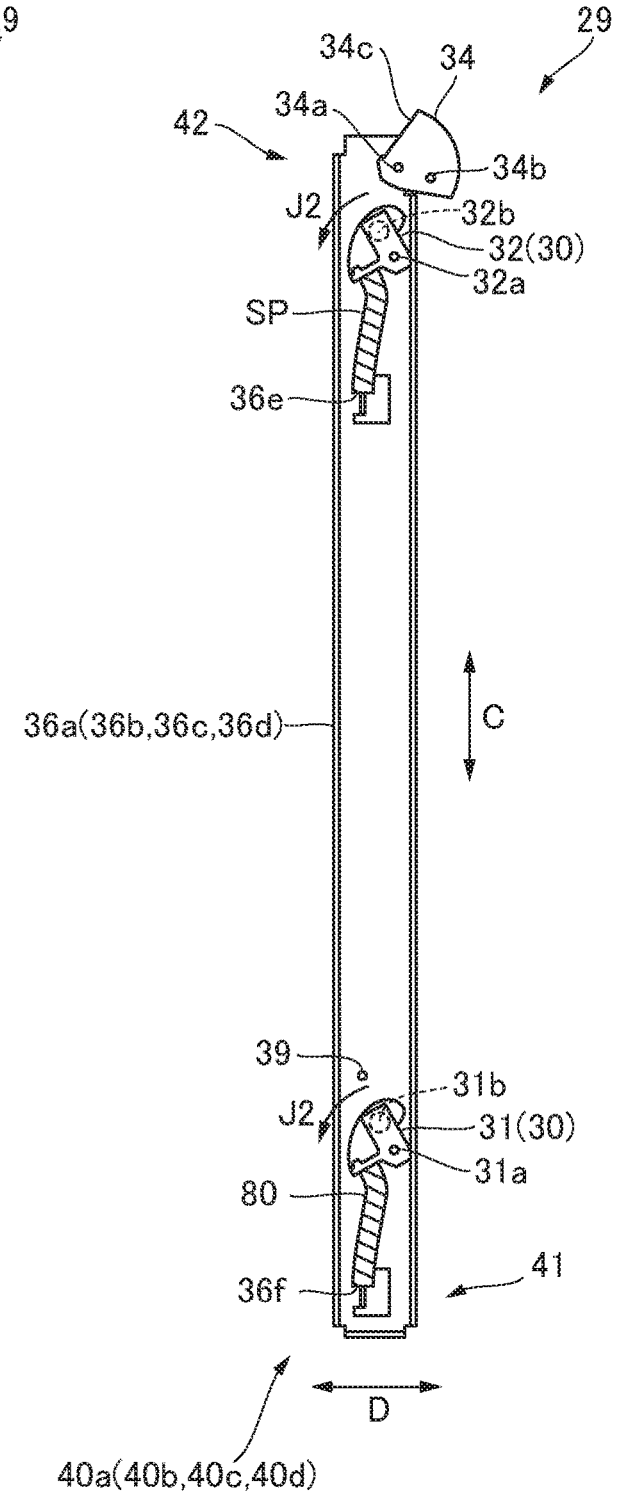
FIG. 7B is a front view showing the stay unit with the pressing mechanism being in a retracting state.
Figure 8:
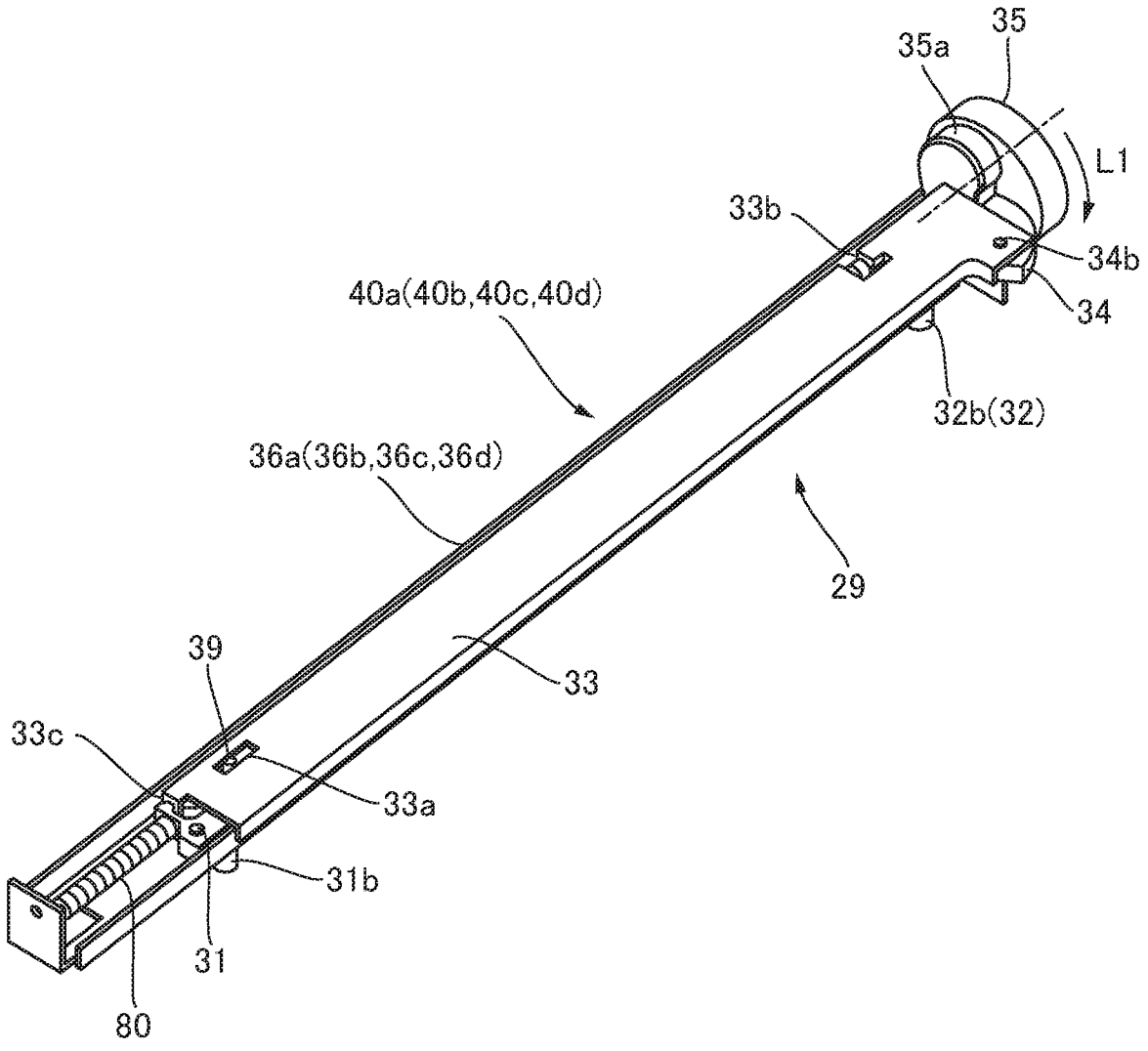
FIG. 8 is a perspective view of the stay unit and a contact/separation cam with the pressing mechanism being in the pressing state.
Figure 9:
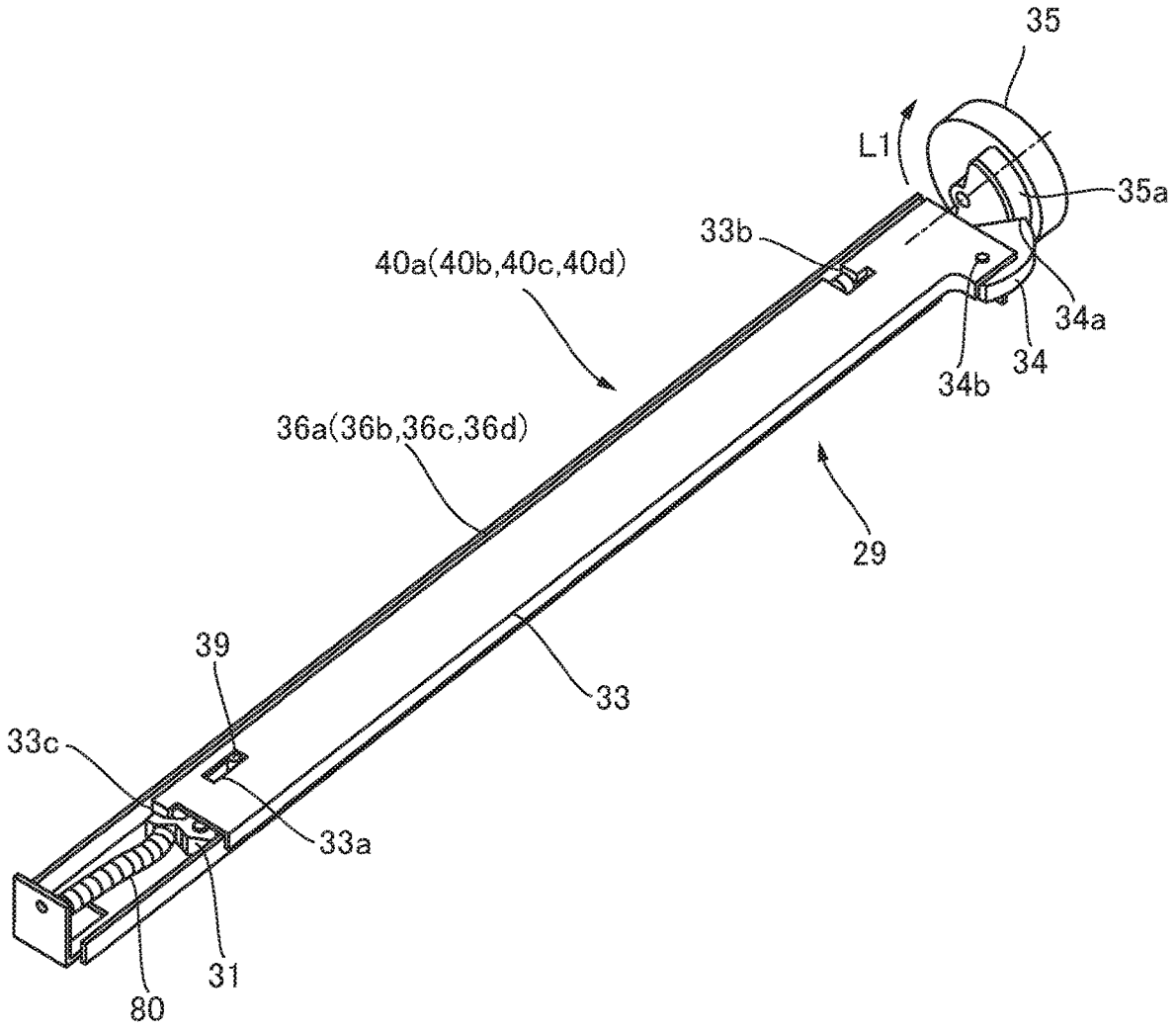
FIG. 9 is a perspective view of the stay unit and the contact/separation cam with the pressing mechanism being in the retracting state.

FIG. 7A is a front view showing the pressing mechanism 29 and the stay 36*a* in a state where the developing roller is at the contact position, and FIG. 7B is a front view showing the pressing mechanism 29 and the stay 36*a* in a state where the developing roller is at a separated position. Further, FIG. 8 is a perspective view showing the pressing mechanism 29 and the stay 36*a* in a state where the developing roller is at the contact position, and FIG. 9 is a perspective view showing the pressing mechanism 29 and the stay 36*a* in a state where the developing roller is at the separated position.

As shown in FIG. 7A, the pressing mechanism 29 is supported by the stay 36*a*, and includes the pressing portion 30 which is movable between a pressing position, at which the pressing portion 30 presses on the pressed portion 28 of the toner container 25*a* to bring the developing roller 24*a* into contact with the photosensitive drum 1*a*, and a retracting position, at which the pressing portion 30 is retracted from the pressing position. Further, the pressing mechanism 29 includes an urging member 80 which urges the pressing portion 30, a contact/separation lever 34 which is pivotably supported by the stay 36*a*, and an interlocking member 33 which couples and interlocks the contact/separation lever 34 and the pressing portion 30.

The pressing portion 30 includes a first pressing member 31 and a second pressing member 32 which are pivotably supported by the stay 36*a* around central shafts 31*a* and 32*a* disposed with a space between each other in the width direction C as a center. These first and second pressing members 31 and 32 are disposed at different positions in the width direction C. In particular, the first pressing member 31 is disposed on a side of a first end portion 41 (front direction) which is one end of the stay 36*a* in the width direction C, and the second pressing member 32 is disposed on a side of a second end portion 42 (back direction) which is another end of the stay 36*a* in the width direction C. Further, each of the first and the second pressing members 31 and 32 includes contact portions 31*b* and 32*b* which are capable to come into contact with the pressed portion 28 of the toner container 25*a*. To be noted, it is preferred that the first and the second pressing members 31 and 32, in pivot ranges thereof, do not protrude in a direction D (horizontal direction in FIG. 1) in FIG. 7A with respect to the stay 36*a*.

The urging members 80 are provided to each of the first and the second pressing members 31 and 32, and first ends of the urging members 80 are supported by urging member holding portions 36*e* and 36*f* of the stay, and second ends of the urging members 80 are supported by the first and the second pressing members 31 and 32. These urging members 80 urge the first and the second pressing member 31 and 32 to pivot in an arrow J1 direction in FIG. 7A so that the first and the second pressing member 31 and 32 are urged from the retracting position to the pressing position. To be noted, it is acceptable to dispose the urging member at one of the first and the second pressing member 31 and 32, and acceptable to dispose the urging member to directly urge the interlocking member not disposing at the first pressing member 31 nor the second pressing member 32.

The contact/separation lever 34 is supported in a manner capable to slide and pivot around a pivot shaft 34*a* as a center with respect to the stay 36*a*, and is supported in a manner capable to pivot around a pivot shaft 34*b*, which is separately disposed from the pivot shaft 34*a* in a radial direction, as a center with respect to the interlocking member 33. To be noted, the pivot shaft 34*a* of the contact/separation lever 34 is disposed in the back direction of the stay 36*a* and further in the back direction of the central shafts 31*a* and 32*a* of the first and the second pressing member 31 and 32. Further, the contact/separation lever 34 is disposed in the back direction of the stay 36*a* further in the back direction of the first and the second pressing member 31 and 32.

The interlocking member 33, which is formed along the width direction C and includes a slide groove 33*a* into which a guide protrusion 39 provided at the stay 36*a* is inserted, is movably supported along the width direction C with respect to the stay 36*a*. To be noted, it is acceptable that a movable range of the stay 36*a* in the width direction C is regulated by the guide protrusion 39 and ends of the slide groove 33*a* in the width direction C. Further, the interlocking member 33 includes contact surfaces 33*b* and 33*c* which are capable to come into contact with the first and the second pressing member 31 and 32. Herewith, the interlocking member 33 couples the contact/separation lever 34 and the first and the second pressing member 31 and 32 so that the contact/separation lever 34 and the first and the second pressing member 31 and 32 are interlocked to pivot together.

As described above, each of the stays 36*a* to 36*d* independently supports the pressing mechanism 29 provided corresponding to each stay. Further, the stays 36*a* to 36*d* and the pressing mechanisms 29 provided corresponding to each stay constitute stay units 40*a*, 40*b*, 40*c*, and 40*d* which are independent from each other. Each of these stay units 40*a*, 40*b*, 40*c*, and 40*d* are attachable to and detachable from the casing 57 in units.

Configuration to Operate Pressing Mechanism

Figure 10A:
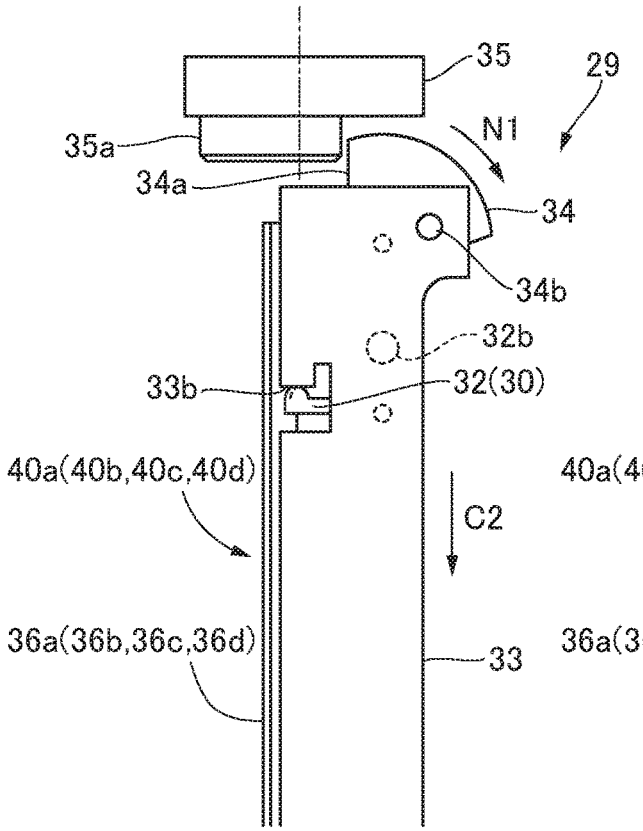
FIG. 10A is a front view of the stay unit and the contact/separation cam with the pressing mechanism being in the pressing state.
Figure 10B:
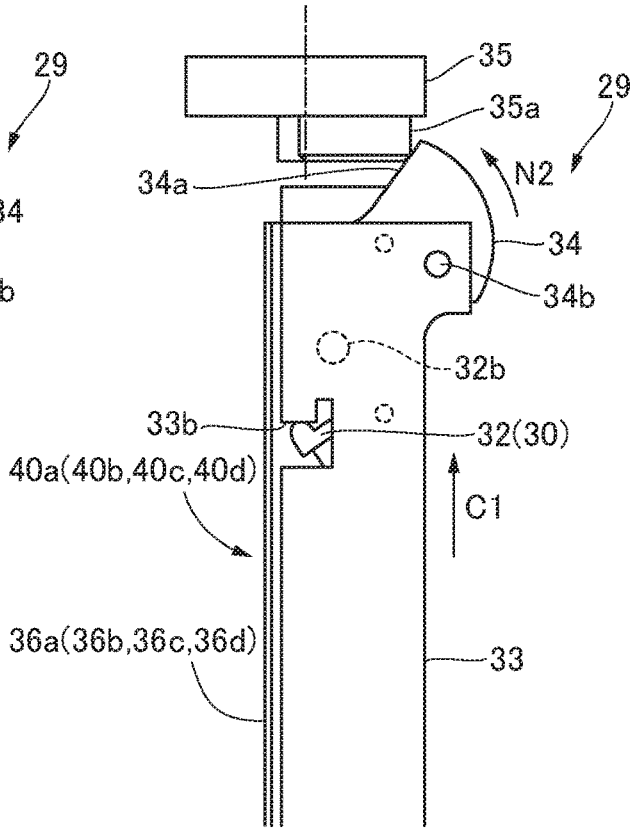
FIG. 10B is a front view of the stay unit and the contact/separation cam with the pressing mechanism being in the retracting state.

FIG. 10A is a front view showing the stay unit 40*a* and a contact/separation cam 35 in a state where the developing roller is at the contact position, and FIG. 10B is a front view showing the stay unit 40*a* and the contact/separation cam 35 in a state where the developing roller is at the separated position. As shown in FIGS. 8 to 10B, each of the pressing mechanisms 29 is provided with the contact/separation cam 35 which is supported in a manner of capable to pivot with respect to the casing 57.

The contact/separation cam 35 is disposed on a side of the back direction side plate 52, and pivoted by a driving device 10 (refer to FIG. 1). For example, the driving device 10 consists of a stepping motor, a control unit to control the stepping motor, and the like. To be noted, it is acceptable to drive each of the contact/separation cams 35 either by a same driving source or by driving sources individually provided to each of the contact/separation cams 35.

Further, the contact/separation cam 35 includes a cam surface 35*a* which is capable to come into contact with a contact surface 34*c* of the contact/separation lever 34 and varies a distance from a pivot axis of the contact/separation cam 35 depending on a pivot position (rotational phase) of the contact/separation cam 35, and changes a pivot position of the contact/separation lever 34 depending on the pivot position of the contact/separation cam 35. To be noted, it is preferred that the cam surface 35*a* is capable to step away from the contact/separation lever 34 at any of the pivot positions of the contact/separation cam 35.

In a case where the pivot position of the contact/separation cam 35 is a first pivot position shown in FIGS. 7A, 8 and 10A, the pressing mechanism 29 is in a pressing state where the first and the second pressing member 31 and 32 are at the pressing position urged by an urging force of the urging member 80. In a case where the pressing mechanism 29 is in the pressing state, the contact portion 31*b* of the first pressing member 31, the contact portion 32*b* of the second pressing member 32, and the pressed portion 28 of the toner container corresponding to such pressing mechanism 29 come into contact with each other, and the pivot positions of the first and the second pressing member 31 and 32 are regulated. Herewith, the developing roller corresponding to such pressing mechanism 29 is held at the contact position by being pressed with the urging member 80 at a predetermined pressure to come into contact with the photosensitive drum via the pressing portion 30 and the toner container.

When the contact/separation cam 35 pivots a predetermined amount from the first pivot position shown in FIGS. 8 and 10A in an arrow L1 direction in FIG. 8, the cam surface 35*a* presses the contact/separation lever 34 to pivot in an arrow N1 direction in FIG. 10A, and the contact/separation cam 35 pivots to a second pivot position shown in FIGS. 9 and 10B. At this time, the interlocking member 33 moves in an arrow C2 direction (front direction) in FIG. 10A as the contact/separation cam 35 pivots, and the first and the second pressing member 31 and 32 pivot in an arrow J2 direction in FIG. 7B, opposing the urging force of the urging member 80, to the retracting position by a movement of the interlocking member 33. In this state, the pressing mechanism 29 is in a retracting state shown in FIGS. 7B, 9, and 10B.

In a case where the pressing mechanism 29 is in the retracting state, the pivot positions of the first and the second pressing member 31 and 32 are regulated by the contact surfaces 33*b* and 33C of the interlocking member 33. Further, when the first and the second pressing member 31 and 32 pivot to the retracting position, the urging force of the urging member 80 is removed, and the toner container corresponding to such pressing mechanism 29 pivots in the arrow F1 direction by the own weight thereof. Herewith, the developing roller corresponding to such pressing mechanism 29 moves to the separated position.

When the contact/separation cam 35 further pivots a predetermined amount in the arrow L1 direction in FIG. 9 from the second pivot position shown in FIGS. 9 and 10B, the contact/separation lever 34 pivots, while being in contact with the cam surface 35*a*, in an arrow N2 direction in FIG. 10B by the urging force of the urging member 80 via the interlocking member 33. Herewith, the contact/separation cam 35 pivots to the first pivot position shown in FIGS. 8 and 10A. At this time, the first and the second pressing member 31 and 32 pivot in the arrow J1 direction in FIG. 7 to the pressing position by the urging force of the urging member 80.

Further, the interlocking member 33 moves in an arrow C1 direction (back direction) in FIG. 10B by pivots of the first and the second pressing member 31 and 32 in the arrow J1 direction, and the pressing mechanism 29 becomes in the pressing state. To be noted, it is acceptable to control the contact/separation cam 35 to pivot in a direction from the second pivot position to the first pivot position in a reverse of a direction (arrow L1 direction in FIG. 8) from the first pivot position to the second pivot position.

By pivoting the contact/separation cam 35 with the driving device 10 as described above, the pressing mechanism 29 operates to move the charge roller to come into contact with and separate from the photosensitive drum. To be noted, each of the contact/separation cams 35 is disposed in a different rotational phase, and a plurality of developing rollers are configured to stagger hours so as to come into contact with and separate from each of the photosensitive drums in a sequence synchronizing with a rotation of the transfer belt. In particular, while one of the process cartridges is performing the image formation, the developing roller of an adjacent process cartridge downstream of the abovementioned process cartridge in the primary transfer moves from the separated position to the contact position. Further, while one of the process cartridges is performing the image formation, the developing roller of an adjacent process cartridge upstream of the abovementioned process cartridge in the primary transfer moves from the contact position to the separated position. Further, it is preferred that the cam surface 35*a* of the contact/separation cam 35 is configured to position all of the developing rollers at the separated position in a state where the image formation is not being performed.

Replacement Work of Stay Unit

Next, a replacement work of the stay units 40*a* to 40*d* will be described using FIGS. 2 and 3. The stays 36*a* to 36*d* include front direction attachment plates 37*a*, 37*b*, 37*c*, and 37*d* at the first end portions 41, which are located at one end (front direction) in the width direction C, to hold the stays 36*a* to 36*d* by the front direction side plate 51. Further, the stays 36*a* to 36*d* include back direction attachment plates 38*a*, 38*b*, 38*c*, and 38*d* at the second end portions 42, which are located at another end (back direction) in the width direction C, to hold the stays 36*a* to 36*d* by the back direction side plate 52.

The front direction attachment plates 37*a* to 37*d* and the back direction attachment plates 38*a* to 38*d* are respectively fixed to the front direction side plate 51 and the back direction side plate 52 by a plurality of fixing members 54, for example, such as screws, which are attachable to and detachable from in the width direction C. Further, each of the front direction attachment plates 37*a* to 37*d* and the back direction attachment plates 38*a* to 38*d* are disposed to face each other in the front direction, and are visible when viewed in the width direction C from the front direction in a state where the corresponding process cartridge to each of the front and back direction attachment plates is removed and the front door 60 is opened. The stays 36*a* to 36*d* are fixed in a form to make the fixing members 54, which fix the first end portion 41 and the second end portion 42 of each stay, visible when viewed in the width direction C from the front direction in a state where the corresponding process cartridge to each of the fixing members 54 is not attached and the front door 60 is opened. For example, the fixing member 54 fixing the front direction attachment plate 37*a* and the fixing member 54 fixing the back direction attachment plate 38*a* are visible when viewed in the width direction C from the front direction in a state where the process cartridge 7*a* is removed and the front door 60 is opened. Further, for example, the fixing member 54 fixing the front direction attachment plate 37*b* and the fixing member 54 fixing the back direction attachment plate 38*b* are visible when viewed in the width direction C from the front direction in a state where the process cartridge 7*b* is removed and the front door 60 is opened. Herewith, workability to attach and detach the stays 36*a* to 36*d* is improved.

To be noted, it is acceptable if the fixing members are disposed to be visible when viewed in the width direction C from the front direction at least in a state where the front door is at the open position and all of the process cartridges are removed. For example, it is acceptable if the fixing members which fix one of the stays out of a plurality of stays are visible when viewed in the width direction C from the front direction at least in a state where the front door is at the open position and the corresponding and adjacent process cartridges to the concerned stay are removed.

Further, it is acceptable to use another fixing device than the screw for the fixing member 54, and also acceptable to configure the front and the back direction attachment plate to be caught by the front and the back direction side plate, respectively, and held in a fastened state. Further, it is preferred that the stay units 40*a* to 40*d* are disposed such that parts of the stay units 40*a* to 40*d* in the back direction of the opening portion 51*a* of the front direction side plate 51 do not overlap each other when viewed from the front direction. Further, it is preferred that the stay units 40*a* to 40*d* are disposed not to overlap with any of other process cartridges when viewed from the front direction in a state where the corresponding process cartridge is removed.

In the embodiment configured as described above, at a time of replacing the stay units 40*a* to 40*d*, at first the worker brings the front door 60 into the open state by opening the front door 60, and brings out the process cartridge corresponding to the stay unit of a target for replacement in the width direction C. Thereafter, the worker removes each of the fixing members 54 which fix the target stay unit 40 to the front and the back direction side plate 51 and 52. At this point, since a direction to detach the fixing members 54 is the direction C which is the same direction as the attachment/detachment direction of the process cartridge 7, it is possible to carry out a work to remove the fixing members 54 by opening the front door 60 and removing the corresponding process cartridge. By removing the fixing members 54, holding of the stay unit by the front and the back direction side plate 51 and 52 is released, and it is possible to remove the target stay unit from the casing 57.

As described above, in this embodiment, it is not necessary to remove all of the process cartridges in a case of attaching and detaching any of the pressing mechanisms 29, and possible to carry out the work in a state where only the process cartridge corresponding to the pressing mechanism 29 for attachment and detachment is removed. Herewith, the workability of replacing the pressing mechanism 29 is improved in this embodiment.

As described above, in this embodiment, the plurality of pressing mechanisms 29 which press each of the developing rollers 24*a* to 24*d* to each of the photosensitive drums 1*a* to 1*d* are respectively attached to the plurality of stays 36*a* to 36*d*, which include the stay 36*a* and the stay 36*b*. Accordingly, vibration which is generated when the pressing mechanism 29 operates and each of the developing rollers 24*a* to 24*d* comes into contact with and is separated from the photosensitive drums 1*a* to 1*d* and deformation of the stay which supports the pressing mechanism 29 are not likely to influence each other among the process cartridges. Herewith, it is possible to improve precision of a distance and contact pressure between each of the developing rollers 24*a* to 24*d* and the photosensitive drums 1*a* to 1*d*.

In general, if the vibration is generated while any of the developing rollers is being in contact with the photosensitive drum to develop the toner image, a patchy pattern is likely to be generated in the toner image in a circumferential direction of the photosensitive drum, and if the stay is deformed, the patchy pattern is likely to be generated in the toner image in the axial direction of the photosensitive drum. By configuring as described above, in this embodiment, it is possible to suppress the patchy patterns in the toner image on the photosensitive drums 1*a* to 1*d* in both of the circumferential and the axial direction, and possible to improve an image quality of the image formed on the sheet.

Further, in this embodiment, the plurality of stays 36*a* to 36*d* to which each of the pressing mechanisms 29 is attached are disposed with a space between each other in a direction in which the photosensitive drums 1*a* to 1*d* are disposed parallel to each other. Therefore, the vibration which is generated when the pressing mechanism 29 operates and each of the developing rollers 24*a* to 24*d* comes into contact with and is separated from the photosensitive drums 1*a* to 1*d* and the deformation of the stay which supports the pressing mechanism 29 are not likely to influence each other among the process cartridges. Herewith, it is possible to improve precision of the distance and contact pressure between each of the developing rollers 24*a* to 24*d* and the photosensitive drums 1*a* to 1*d*.

Further, in this embodiment, each of the pressing mechanisms 29 and the plurality of stays 36*a* to 36*d* are attachable to and detachable from the casing 57 independently from each other. In general, since the patchy pattern becomes likely to be generated in the toner image on the photosensitive drum if the contact pressure of the developing roller on the photosensitive drum changes, for example, in a case where the contact pressure has changed by wear of the pressing portion or deterioration of the urging member due to use for a long period of time, it is necessary to replace these components.

However, in a case of individually bringing out the pressing portion and the urging member, since the urging force of the urging member is provided to the pressing portion, the replacement work is not only annoying, but also a mistake may happen in assembly after the replacement. In a case where a plurality of pressing members are provided to one piece of the developing roller, the replacement work is more difficult than a case where one piece of the pressing member is provided. In this embodiment, since it is not necessary to remove and replace the pressing portion and the urging member individually from the stay supporting the pressing mechanism 29, it is easy to replace the pressing mechanisms 29 as needed, and possible to suppress the deterioration of the image quality of the image formed on the sheet.

Other Embodiments

To be noted, while, in this embodiment, the plurality of stays 36*a* to 36*d* are disposed with the space between each other in a direction in which the plurality of photosensitive drums 1*a* to 1*d* are arranged, it is not limited to this. For example, in a case where each of the plurality of stays is formed as an independent component from each other, it is acceptable to dispose each of the plurality of stays to come into contact with each other at least partially, or acceptable to dispose each of the plurality of stays without the space between each other.

Further, while each of the plurality of stays 36*a* to 36*d* is attachable to and detachable from the casing 57 independently from each other, it is not limited to this. For example, the ends of the plurality of stays in the width direction may be fixed to the front and the back direction side plate by welding. Further, for example, the plurality of stays may be integrally formed with a casing body portion.

Further, while each of the first end portions 41 and the second end portions 42 of the plurality of stays 36*a* to 36*d* are fixed to the front and the back direction side plate 51 and 52 in this embodiment, a component which fixes the plurality of stays is not limited to be formed in a plate shape. For example, the ends of each of the plurality of stays may be fixed to a frame-shaped member which is disposed to face the axial direction of the first photosensitive drum, or fixed to a box-shaped exterior portion of the printer body.

Further, while, in this embodiment, it is configured that the driving device pivots the contact/separation cam 35 which moves the interlocking member 33 which pivots the first and the second pressing member 31 and 32 between the pressing position and the retracting position, it is not limited to this. For example, it is acceptable to configure the pressing mechanism such that the driving device pivots one of the first and the second pressing members and the interlocking member transmits a pivot force of one of the pressing members to another pressing member so as to pivot the other pressing member. Further, for example, it is acceptable to configure the pressing member to move in a linear manner by an electromagnetic actuator such as a solenoid, and acceptable to configure the driving device to directly control a position of the interlocking member, and other variety of mechanisms may be considered.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-168727, filed Sep. 17, 2019, which is hereby incorporated by reference herein in its entirety.

What is claimed is:

1. An image forming apparatus comprising:

a casing;

a first photosensitive drum on which an electrostatic latent image is to be formed, the first photosensitive drum being configured to rotate about a first rotation axis;

a second photosensitive drum disposed next to the first photosensitive drum, and on which an electrostatic latent image is to be formed, the second photosensitive drum being configured to rotate about a second rotational axis;

a first developing unit comprising a first developing member configured to develop the electrostatic latent image formed on the first photosensitive drum by supplying a toner to the first photosensitive drum, the first developing unit being configured to be movable between a first position where the first developing member comes into contact with the first photosensitive drum and a second position where the first developing member is separated from the first photosensitive drum;

a second developing unit comprising a second developing member configured to develop the electrostatic latent image formed on the second photosensitive drum by supplying a toner to the second photosensitive drum, the second developing unit being configured to be movable between a third position where the second developing member comes into contact with the second photosensitive drum and a fourth position where the second developing member is separated from the second photosensitive drum;

a first pressing mechanism configured to press the first developing unit so that the first developing unit is moved from the second position to the first position;

a second pressing mechanism configured to press the second developing unit so that the second developing unit is moved from the fourth position to the third position;

a first stay to which the first pressing mechanism is attached, and which is supported by the casing, a longitudinal direction of the first stay being a direction of the first rotational axis; and a second stay to which the second pressing mechanism is attached, and which is supported by the casing, a longitudinal direction of the second stay being a direction of the second rotational axis.

2. The image forming apparatus according to claim 1, wherein the second stay is disposed with a distance from the first stay in a direction in which the first photosensitive drum and the second photosensitive drum are arranged.

3. The image forming apparatus according to claim 1, wherein the casing comprises a first side plate and a second side plate disposed to face the first side plate in the direction of the first rotational axis, wherein the first stay has a first end portion and a second end portion opposite to the first end portion in the longitudinal direction of the first stay, and the second stay has a third end portion and a fourth end portion opposite to the third end portion in the longitudinal direction of the second stay, the first end portion of the first stay and the third end portion of the second stay are supported by the first side plate, and the second end portion of the first stay and the fourth end portion of the second stay are supported by the second side plate.

4. The image forming apparatus according to claim 3, further comprising:

first and second fixing members configured to fix the first stay and the second stay to the casing, respectively;

an openable door configured to be moved between a closed position in which the openable door covers an opening formed in the first side plate and an open position in which the openable door exposes the opening outside;

a first process cartridge comprising the first photosensitive drum and the first developing unit, and configured to be detachably attached to the casing through the opening; and a second process cartridge comprising the second photosensitive drum and the second developing unit, and configured to be detachably attached to the casing through the opening, wherein, in a state where the openable door is at the open position and the first process cartridge and the second process cartridge are not attached to the casing, the first stay and the second stay are fixed to the casing in a form in which the first and second fixing members are visible when viewed in the direction of the first rotational axis.

5. The image forming apparatus according to claim 1, wherein the first developing unit comprises a developer container configured to store a toner which is to be supplied to the first photosensitive drum via the first developing member, the developer container being configured to rotatably support the first developing member, the developer container being configured to swing around a swing axis, and wherein the first pressing mechanism comprises a pressing portion configured to be moved between a pressing position where the pressing portion presses the developer container so that the first developing unit is swung from the second position to the first position, and a retracting position where the pressing portion is retracted from the pressing position, and an urging member configured to urge the pressing portion in a direction from the retracting position to the pressing position.

6. The image forming apparatus according to claim 5, wherein the pressing portion comprises a first pressing member disposed on a side of a first end portion of the first stay and configured to press the developer container, and a second pressing member disposed on a side of a second end portion of the first stay opposite to the first end portion in the longitudinal direction of the first stay and configured to press the developer container, and the first pressing mechanism comprises an interlocking member configured to interlock the first pressing member and the second pressing member.

7. The image forming apparatus according to claim 5, wherein, when the pressing portion is positioned at the retracting position, the developer container is configured to swing around the swing axis by an own weight of the developer container, thereby the first developing unit being moved to the second position.

8. The image forming apparatus according to claim 1, wherein the first developing unit is swingable between the first position and the second position about a first swing axis, and the second developing unit is swingable between the third position and the fourth position about a second swing axis, wherein the first rotational axis and the second rotational axis are disposed above the first swing axis and the second swing axis, respectively, and wherein the first stay and the second stay are disposed above the first swing axis and the second swing axis, respectively.

9. The image forming apparatus according to claim 8, wherein the first stay is disposed between the first developing unit and the second photosensitive drum in a direction in which the first photosensitive drum and the second photosensitive drum are arranged.

10. An image forming apparatus comprising:

a casing;

a first photosensitive drum on which an electrostatic latent image is to be formed, the first photosensitive drum being configured to rotate about a first rotational axis;

a second photosensitive drum disposed next to the first photosensitive drum, and on which an electrostatic latent image is to be formed, the second photosensitive drum being configured to rotate about a second rotational axis;

a first developing unit comprising a first developing member configured to develop the electrostatic latent image formed on the first photosensitive drum by supplying a toner to the first photosensitive drum, the first developing unit being configured to swing, about a first swing axis, between a first position where the first developing member comes into contact with the first photosensitive drum and a second position where the first developing member is separated from the first photosensitive drum, the first swing axis being disposed below the first rotational axis;

a second developing unit comprising a second developing member configured to develop the electrostatic latent image formed on the second photosensitive drum by supplying a toner to the second photosensitive drum, the second developing unit being configured to swing, about a second swing axis, between a third position where the second developing member comes into contact with the second photosensitive drum and a fourth position where the second developing member is separated from the second photosensitive drum, the second swing axis being disposed below the second rotational axis;

a first pressing mechanism configured to press the first developing unit so that the first developing unit is swung from the second position to the first position;

a second pressing mechanism configured to press the second developing unit so that the second developing unit is swung from the fourth position to the third position;

a first stay to which the first pressing mechanism is attached, and which is supported by the casing, the first stay being disposed above the first swing axis; and a second stay to which the second pressing mechanism is attached, and which is supported by the casing, the second stay being disposed above the second swing axis.

11. The image forming apparatus according to claim 10, wherein the first stay is disposed between the first developing unit and the second photosensitive drum in a direction in which the first photosensitive drum and the second photosensitive drum are arranged.

12. The image forming apparatus according to claim 10, wherein the second stay is disposed with a distance from the first stay in a direction in which the first photosensitive drum and the second photosensitive drum are arranged.

13. The image forming apparatus according to claim 10, wherein the casing comprises a first side plate and a second side plate disposed to face the first side plate in a direction of the first rotational axis, and wherein the first stay has a first end portion and a second end portion opposite to the first end portion in a longitudinal direction of the first stay, and the second stay has a third end portion and a fourth end portion opposite to the third end portion in a longitudinal direction of the second stay, the first end portion of the first stay and the third end portion of the second stay are supported by the first side plate, and the second end portion of the first stay and the fourth end portion of the second stay are supported by the second side plate.

* * * * *